US005890474A

United States Patent [19]

Schnaibel et al.

[11] Patent Number: 5,890,474

[45] Date of Patent: Apr. 6, 1999

[54] METHOD AND ARRANGEMENT FOR CHECKING THE OPERABILITY OF A TANK-VENTING SYSTEM

[75] Inventors: Eberhard Schnaibel, Hemmingen; Helmut Schwegler, Pleidelsheim; Ulrich Kuhn, Renningen; Werner Krauss, Buehl; Thorsten Fritz, Gaggenau; Andreas Blumenstock, Ludwigsburg; Stephan Uhl, Stuttgart; Michael Nicolaou, Ober-Ramstadt; Lutz Reuschenbach, Stuttgart; Georg Mallebrein, Singen; Michael Hermann, Lauf, all of Germany

[73] Assignee: Robert Bosch GmbH, Stuttgart, Germany

[21] Appl. No.: 900,335

[22] Filed: Jul. 25, 1997

[30] Foreign Application Priority Data

Sep. 7, 1996 [DE] Germany ..... 196 36 431.0

[51] Int. Cl.[6] ..... F02M 37/04

[52] U.S. Cl. ..... 123/520; 123/198 D

[58] Field of Search ..... 123/198 D, 520, 123/519, 518, 516, 521

[56] References Cited

U.S. PATENT DOCUMENTS

| | | | |
|---|---|---|---|
| 5,297,529 | 3/1994 | Cook | 123/198 D |
| 5,383,437 | 1/1995 | Cook | 123/520 |
| 5,411,004 | 5/1995 | Busato | 123/520 |
| 5,460,141 | 10/1995 | Denz | 123/198 D |
| 5,483,942 | 1/1996 | Perry | 123/198 D |
| 5,499,614 | 3/1996 | Busato | 123/198 D |
| 5,553,577 | 9/1996 | Denz | 123/198 D |
| 5,685,279 | 11/1997 | Blomquist | 123/520 |

*Primary Examiner*—Carl S. Miller
*Attorney, Agent, or Firm*—Walter Ottesen

[57] ABSTRACT

The invention is directed to a method and arrangement for checking the operability of a vessel. Pressure is introduced into the vessel utilizing a pressure source having operating variables which vary during operation of the pressure source. These operating variables are detected while the pressure is introduced into the vessel and a conclusion as to a presence of a leak in the vessel is drawn from the operating variables. By utilizing the operating variables, a statement as precise as possible is provided as to the presence of the leak with as little additional equipment as possible.

12 Claims, 5 Drawing Sheets

METHOD AND ARRANGEMENT FOR CHECKING THE OPERABILITY OF A TANK-VENTING SYSTEM

FIELD OF THE INVENTION

The invention relates to a method for checking the operability of a vessel such as a venting system including a tank, an adsorption filter and a tank-venting valve. The adsorption filter has a venting line and is connected via a tank-connecting line to the tank. The tank-venting valve is connected to the adsorption filter via a valve line with which a pressure is introduced into the vessel by means of a pressure source. The presence of a leak is concluded from the course of the pressure and/or pumped volume flow.

BACKGROUND OF THE INVENTION

Vessels must be checked in different areas of technology with respect to their operability, that is, with respect to tightness. Thus, in the chemical industry or in the process industry for example, it is important that the tightness of vessels be checked. Furthermore, it is however also necessary to check the tightness, especially of tank systems, in the motor vehicle industry.

For example, the California Environmental Authority (CARB) as well as the Environmental Protection Agency (EPA) require a check of the operability of tank-venting systems in motor vehicles utilizing on-board diagnostic means (On-board Diagnosis, OBD II). Starting with the model year 1996, leaks of the size of 1 mm or more must be detected and starting with the model year 2000, the detection of leaks starting with a size of 0.5 mm is required. Such leaks must, for example, be indicated in the motor vehicle and be stored in a memory.

U.S. Pat. No. 5,349,935 discloses a method and an arrangement for checking the operability of a tank-venting system wherein an overpressure is introduced into the tank-venting system by means of a secondary air pump. The presence of a leak is subsequently concluded from an evaluation of the course of the pressure.

It is disadvantageous with respect to this method and this arrangement that a secondary air pump is not present in all vehicles. Furthermore, a pressure sensor is necessary to evaluate the course of the pressure. The sensor is not only an additional element of the tank-venting system which can malfunction but also makes the system more expensive.

Furthermore, an arrangement for checking the operability of a tank-venting system is known wherein the overpressure is introduced into the tank-venting system by means of a pump or pressure source. The volume flow introduced is measured at a diaphragm by means of a difference pressure measurement and, thereafter, a decision is made as to whether a leak is present or not from a comparison with a programmable threshold.

It is a disadvantage of this arrangement that a measurement of an absolute volume flow is required which is compared to a threshold. This absolute measurement of the volume flow is problematic for the reason that the total of tolerances of the flow machine go into the measurement, for example, the tolerance of the output volume flow. In addition, a pressure sensor for measuring the pressure is required even in this arrangement. This sensor not only makes the entire method and arrangement more complex but also more expensive.

A further method is known for checking the operability of a tank-venting system wherein a reference leak is switched into the tank-venting system and wherein a statement as to the presence of a leak is made from a comparison of the measurements with and without the reference leak.

Also, U.S. Pat. No. 5,347,971 discloses a method for checking the operability of a tank-venting system wherein a conclusion as to the tightness of the system is reached from a comparison of the measurements with and without a reference leak.

In the two last-mentioned methods, it is problematical that a proper reference measurement is not possible between a reference leak and a leak present in the tank-venting system because a leak, which is possibly present in the tank-venting system, always affects the measurement, even when the reference leak is switched in. The reference leak is accordingly not a proper reference leak and, instead, should rather be characterized as an "offset" leak. With this offset leak, measurement inaccuracies can be expected in the check of the operability of a tank-venting system.

A method wherein the check of the operability of a tank-venting system takes place with the aid of a proper reference leak is disclosed in U.S. Pat. No. 5,390,645. In this method, the volume flow of a blower motor is split so that it simultaneously flows through a reference leak and into the tank-venting system. A conclusion as to the presence of the leak is reached from a comparison of the flow in the two flow paths wherein the flows are detected by through-flow sensors mounted in the respective paths.

However, a disadvantage of this method is that two relatively complex through-flow sensors are required to carry out the method. Furthermore, it is a disadvantage in this method that the overpressure source is mounted in the flow path of the regeneration air of an adsorption filter because this regeneration air often contains dirt and water mist, salt water and the like which can disadvantageously affect the function of the overpressure source. This operates unfavorably on the service life of the overpressure source.

SUMMARY OF THE INVENTION

It is an object of the invention to improve upon a method for checking the operability of a vessel and especially a tank-venting system of the kind described above by providing the most precise statement as to the presence of a leak in the vessel with the least possible additional equipment. Also, a genuine reference measurement is carried out.

The method of the invention is for checking the operability of a vessel. The method includes the steps of: introducing a pressure into the vessel utilizing a pressure source having operating variables which vary during operational use thereof; detecting the operating variables while introducing the pressure into the vessel; and, drawing a conclusion as to a presence of a leak in the vessel from the operating variables.

The detection of the operating variables of the pressure source when introducing the pressure and the conclusion as to the presence of a leak on the basis of these operating variables affords the special advantage that additional equipment such as pressure sensors, through-flow sensors and the like are completely unnecessary because a conclusion as to the presence of a leak is based solely on the operating variables of the pressure source. This additional equipment would, in part, be technically complex, subject to malfunction and expensive.

In principle, it would be possible to detect the operating variables of the pressure source initially based on a comparison leak and to store these variables in a memory. Then, these operating variables are compared to operating variables detected in later measurements and a conclusion as to the presence of a leak is drawn. In this way, a conclusion as to the presence of a leak can be drawn with relative accuracy. However, it is not possible in such a method to consider, for example, the deterioration effects of the tank-venting system or of the motor vehicle or to consider additional variables, which influence the measurement, such as temperature, air pressure of the atmosphere and the like.

For this reason, an especially advantageous embodiment considers especially different operating conditions of the vehicle and especially also operating conditions which are caused by deterioration. In this embodiment, the tank-venting system and a reference leak are alternately charged with an overpressure and the operating variables of the pressure source are detected when introducing the pressure into the tank-venting system and when introducing the pressure into the reference leak. These operating variables are then compared to each other and a conclusion as to the presence of a leak is drawn therefrom.

The presence of a reference leak has the substantial advantage that, on the one hand, representative comparison operating variables for an existing leak must not be stored in a memory and the memory is therefore not needed and, on the other hand, all operating conditions of the vehicle, temperature, deterioration and the like can be considered.

Various embodiments are conceivable with respect to the arrangement of the reference leak.

An especially advantageous embodiment of the invention provides that the reference leak is arranged parallelly to the tank-venting system. This embodiment makes possible especially an accurate reference measurement as described above.

Another advantageous embodiment provides that the reference leak is simulated by a controlled partial opening of the tank-venting valve. In this way, an additional reference leak branch in the tank-venting system can be omitted. In an especially advantageous manner, and in addition to the foregoing, any desired leak size can be realized with the controlled partial opening of the tank-venting valve.

The arrangement of the invention is for checking the operability of a vessel and the arrangement includes: a pressure source for charging the vessel with a pressure; the pressure source having operating variables which vary during operational use thereof; and, a circuit unit for detecting and evaluating the operating variables as the pressure is introduced into the vessel.

The operating variables of the pressure source change with the presence of a leak. For this reason, a conclusion can be drawn in a simple manner as to the presence of a leak by detecting and evaluating the operating variables of the pressure source in the circuit unit. This detection and evaluation is without additional equipment such as pressure sensors, flow sensors and the like.

To precisely check the operability of a vessel, it has been shown to be especially advantageous to mount a reference leak parallel to the vessel. A pressure source can be alternately connected to the vessel and to the reference leak via a switching device. This is especially the case with respect to a tank-venting system and where operating conditions change which changes, for example, are caused by changing environmental influences or by deterioration.

Different valves can be used with respect to the switching device. Preferably, the switching device is a 3/2-way valve or a 4/2-way valve.

Another possibility provides that, in the case of a tank-venting system, the tank-venting valve is, for example, driven so that it opens, for example, via a clocked drive; whereas, the tank-venting system is charged by the pressure source with pressure.

A desired reference leak is simulated by the controlled opening of the tank-venting valve whereby the reference leak arranged in the tank-venting system can be omitted. Furthermore, in this case, the above-mentioned switching device in the form of a 3/2-way valve or a 4/2-way valve can be omitted and replaced by a conventional check valve which is mounted parallel to the line branch leading to the pressure source.

With respect to the pressure source, the most different embodiments are possible. An advantageous embodiment provides that the pressure source is an electrically-driven pump.

The current consumed and/or the rpm of the pump and/or the voltage applied to the pump can be detected as operating variables and be evaluated.

BRIEF DESCRIPTION OF THE DRAWINGS

The invention will now be described with reference to the drawings wherein.

DESCRIPTION OF THE PREFERRED EMBODIMENTS OF THE INVENTION

The method and the arrangement of the invention are explained below in the context of a tank-venting system. It is understood that the invention applies to any desired vessel which is intended to be checked as to operability, namely, tightness.

Figure 4:
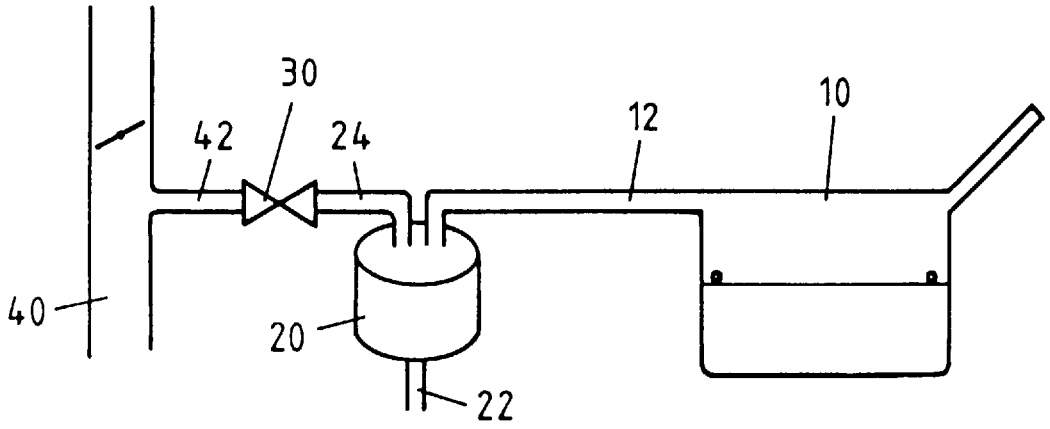
FIG. 4 is a schematic of a known tank-venting system.

A tank-venting system of a motor vehicle tank system is shown in FIG. 4 and includes: a tank 10, an adsorption filter 20 as well as a tank-venting valve 30. The adsorption filter 20 can, for example, be an active charcoal filter which is connected to the tank 10 via a tank connecting line 12 and has a venting line 22 connected to the ambient. The tank-venting valve is, on the one hand, connected to the adsorption filter 20 via a valve line 24 and, on the other hand, to an intake pipe 40 of an internal combustion engine via a valve line 42.

Hydrocarbons form in the tank 10 by vaporization and deposit in the adsorption filter 20. The tank-venting valve 30 is opened to regenerate the adsorption filter 20 so that, because of an underpressure present in the intake pipe 40, air of the atmosphere is drawn by suction through the adsorption filter 20 whereby the hydrocarbons, which had deposited on the adsorption filter 20, are drawn by suction into the intake pipe 40 and supplied to the internal combustion engine (not shown).

Figure 1:
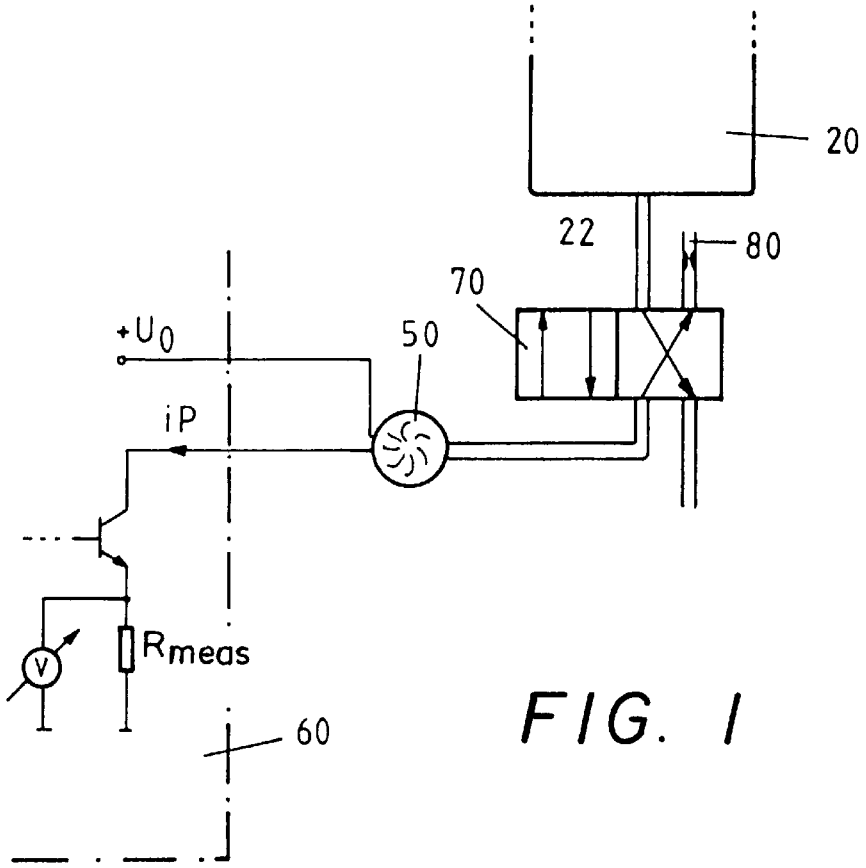
FIG. 1 is a schematic representation of an embodiment of an arrangement according to the invention for checking the operability of a tank-venting system.

A first embodiment of the arrangement of the invention for checking the operability of a tank-venting system is shown in FIG. 1.

As shown in FIG. 1, such an arrangement includes a pump 50 which is connected to a circuit unit 60. A switchover valve is connected downstream of the pump 50 and is in the form of a 4/2-way valve 70. On the one hand, the adsorption filter 20 is connected downstream of the 4/2-way valve 70 via the venting line 22 while, on the other hand, a reference leak 80 is connected downstream of the 4/2-way valve. In its first switch position, a connection between the pump 50 and the tank-venting system is established via the venting line 22 and the adsorption filter 20 so that the tank-venting system can be charged with pressure by the pump 50. In its other switch position, the reference leak 80 can be charged with pressure by the pump.

During the introduction of a pressure, the current input of the pump can, for example, be detected by the circuit shown in FIG. 1 which is part of the circuit unit 60. The current input of the pump can be detected by tapping the voltage at a measurement resistor $R_{meas}$, which is connected in the emitter line of a transistor driving the pump 50. The current input is a measure for the pump volume flow of the pump 50.

This pump volume flow is, on the one hand, determined when the tank-venting system is charged with pressure by the pump 50 and, on the other hand, when the reference leak 80 is charged by the pump 50 with pressure. A comparison of the two quantities facilitates a determination as to the presence of a leak in the tank-venting system in a manner described hereinafter.

Figure 2:
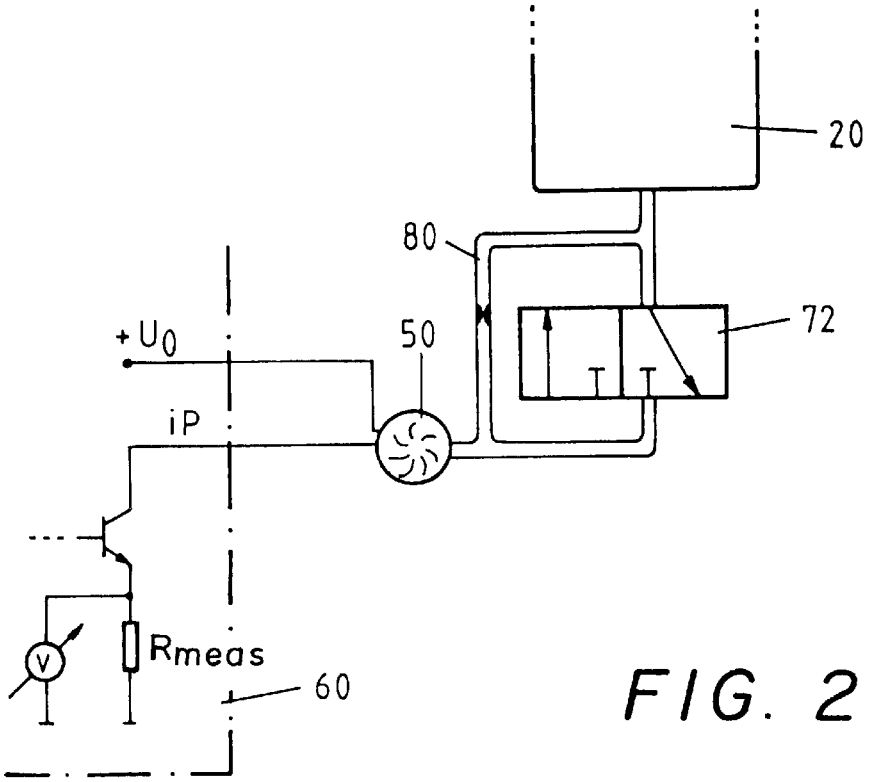
FIG. 2 is another embodiment of an arrangement of the invention for checking the operability of a tank-venting system.

In FIG. 2, another embodiment of the arrangement of the invention is shown which differs from the arrangement shown in FIG. 1 only in that a 3/2-way valve 72 is used in lieu of a 4/2-way valve 70. In this case, the reference leak 80 is arranged parallel to the 3/2-way valve.

It is understood that the size of the reference leak 80 is so selected that it corresponds precisely to the size of the leak to be detected.

Figure 1A:
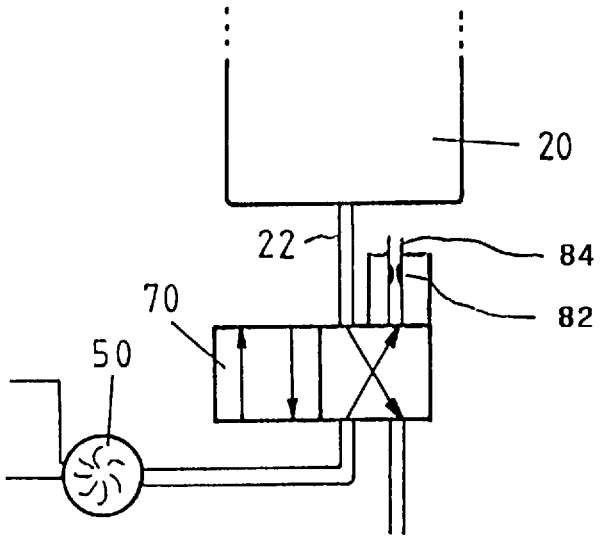
FIG. 1*a* is a detail schematic showing the valve of the embodiment of FIG. 1 having a narrowed channel defining a reference leak within the valve.

The reference leak 80 can then, for example, also be a part of the switchover valve (70, 72) such as a narrowing 82 of a channel 84 as shown schematically in FIG. 1*a* so that an additional reference component branch can be omitted in this case.

Figure 3:
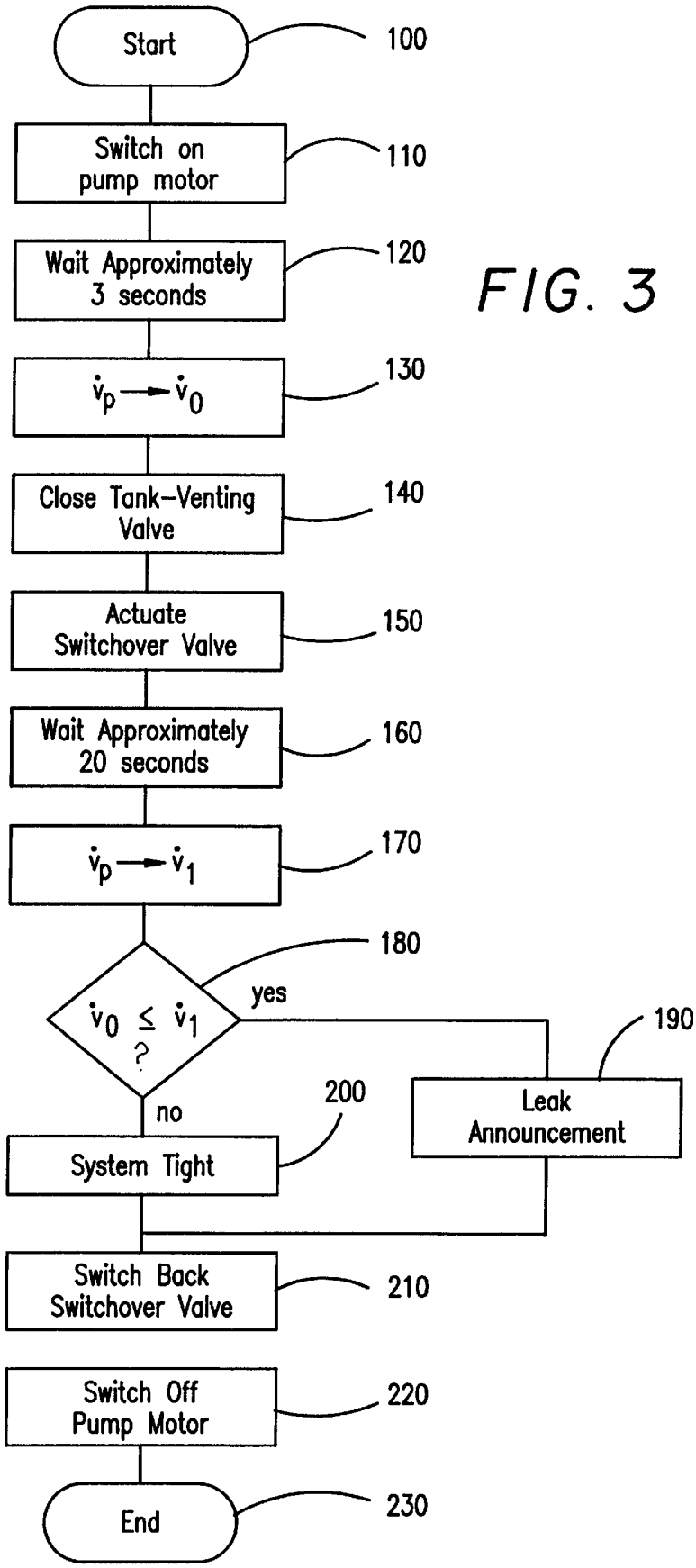
FIG. 3 is a schematic flowchart showing the method sequence of an embodiment of the method of the invention.

The method for checking the operability of a tank-venting system is explained with respect to the flowchart shown in FIG. 3. After the start of the program in step 100 and the switch-on of the pump motor in step 110, a time delay of approximately three seconds first elapses in step 120. This step serves to adjust the steady-state condition. Thereafter, in step 130, the pump current $\dot{v}_p$ is determined from an operating characteristic variable of the pump motor 50 and stored as a reference pump flow $\dot{v}_o$. Steps 110 to 130 define a reference measurement for a pregiven leak 80.

In step 140, the tank-venting valve 30 is closed and the 4/2-way valve 70 shown in FIG. 1 or the 3/2-way valve 72 shown in FIG. 2 is actuated (step 150) so that the tank-venting system can be subjected to a pressure. Thereafter, in step 160, a further delay time of approximately 20 seconds elapses which serves to fill the tank and to await the adjustment of a steady-state condition. Thereafter, in step 170 the pump flow $\dot{v}_p$ of the pump 50 is determined again from motor operating variables and stored as a measurement pump flow $\dot{v}_1$.

Thereafter, in method step 180, a comparison is made of the reference pump flow $\dot{v}_o$ of step 130 and the measurement pump flow $\dot{v}_1$ of step 170. A comparison is made as to whether the reference pump flow $\dot{v}_o$, (step 130) is less or equal to the measurement pump flow $\dot{v}_1$ of the tank-venting system (step 170). If this is the case, then a fault announcement is outputted in step 190 (for example, a leak announcement) and the switchover valve is switched back in step 210 and the pump motor 50 is switched off in step 220. If this is not the case, then an announcement of the content "system tight" (step 200) is outputted and then, in step 210, the switchover valve is switched back and the motor 50 is switched off (step 220). The method is then ended in step 230.

The advantage of this method is a genuine reference measurement with a reference leak 80. Additional pressure sensors, flow sensors or the like become unnecessary because of the detection of the pump flow of the pump 50 via operating variables of the pump, such as the current input or the rpm, voltage at the pump and the like.

Figure 5:
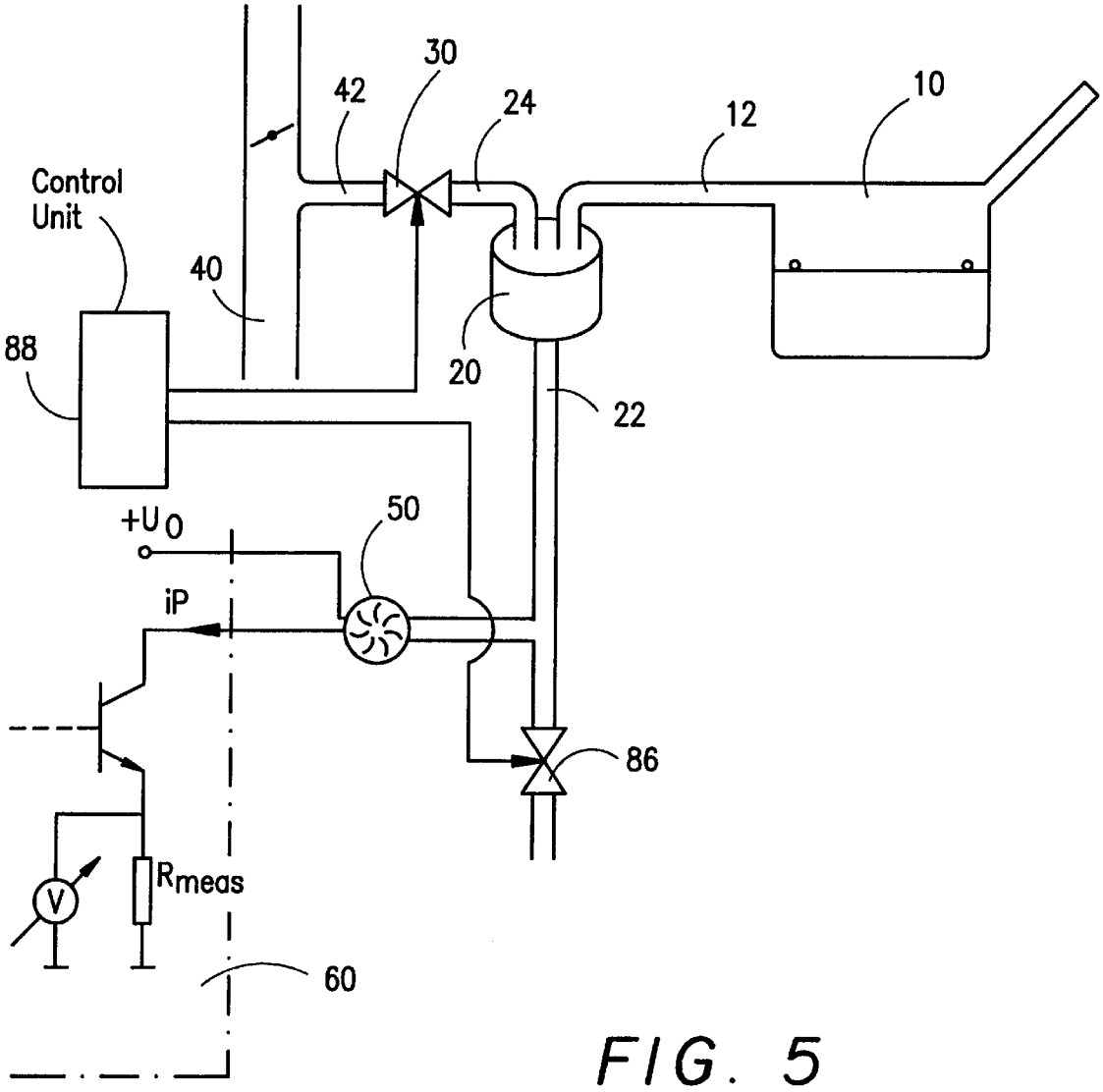
FIG. 5 is a schematic representation of still another embodiment of the invention wherein a reference leak is simulated by a controlled opening of the tank-venting valve.

A further embodiment is shown in FIG. 5 and provides that the tank-venting valve 30 can be controlled to be openable to simulate a leak of any desired size. In this case, switchover valves such as the 4/2-way valve (shown in FIG. 1) or the 3/2-way valve (shown in FIG. 2) can be omitted and it is only necessary to provide a shutoff valve 86 in a line branch parallel to the pressure source, which is closed when a check as to operability of the tank-venting system is undertaken, and which is open in the remaining cases. In FIG. 5, a control unit 88 contains a microprocessor and outputs control signals to the tank-venting valve 30 and the shutoff valve 86.

It is emphasized that it is irrelevant in which sequence the measurement of the pump flows takes place. It is unimportant as to the quality of the measurement whether the reference measurement is first made or the measurement of the tank-venting system or vice versa.

It is emphasized also that the pressure source is not mounted in the flow path of the regeneration air of the adsorption filter 20 when no check as to operability of the tank-venting system is undertaken so that dirt, water, vapor, salt water and the like (which can be constituents of the regeneration air) cannot disadvantageously affect the pump 50, for example, by shortening the service life thereof.

It is understood that the foregoing description is that of the preferred embodiments of the invention and that various changes and modifications may be made thereto without departing from the spirit and scope of the invention as defined in the appended claims.

What is claimed is:

1. An arrangement for checking the operability of a tank-venting system of an internal combustion engine, the arrangement comprising:

a pressure source for charging said tank-venting system with a pressure;

said pressure source having operating variables which vary during operational use thereof;

a circuit unit for detecting and evaluating said operating variables as said pressure is introduced into said vessel;

the tank-venting system including a tank, an adsorption filter, a tank-connecting line connecting the tank to the adsorption filter, a tank-venting valve; a first valve line connecting the tank-venting valve to the adsorption filter and a second valve line connecting the tank-venting valve to an intake pipe of the internal combustion engine;

said tank-venting valve being movable to an open position; and, control means for controlling said tank-venting valve to said open position while said pressure source charges said tank-venting system with pressure so as to cause a simulation of a reference leak in said tank-venting system which is directed toward said intake pipe of said internal combustion engine.

2. A method for checking the operability of a vessel, the method comprising the steps of:

introducing a pressure into said vessel utilizing a pressure source having operating variables which vary during operational use thereof and which operating variables include current input to said pressure source, rpm of said pressure source and voltage applied to said pressure source;

selecting at least one of said operating variables as a diagnostic variable;

detecting said at least one operating variable while introducing said pressure into said vessel; and, drawing a conclusion as to a presence of a leak in said vessel from said operating variable.

3. A method for checking the operability of a vessel, the method comprising the steps of:

introducing a pressure into said vessel utilizing a pressure source having operating variables which vary during operational use thereof;

detecting said operating variables while introducing said pressure into said vessel;

drawing a conclusion as to a presence of a leak in said vessel from said operating variables;

providing a reference leak connected in parallel to said vessel;

alternately charging said vessel and said reference leak with pressure;

detecting said operating variables of said pressure source as said pressure is introduced into said vessel and into said reference leak; and, comparing the operating variables obtained with respect to said vessel to the operating variables obtained with respect to said reference leak and drawing a conclusion from the comparison as to the presence of a leak in said vessel.

4. The method of claim 3, wherein said operating variables of said pressure source include at least one of the following:

current input to said pump source, rpm of said pump source and voltage applied to said pump source.

5. The method of claim 3, wherein said vessel is a tank-venting system, the tank-venting system including a tank, an adsorption filter, a tank-connecting line connecting the tank to the adsorption filter, a tank-venting valve; and, a valve line connecting the tank-venting valve to the adsorption filter; and, wherein the method comprises the further step of connecting said reference leak in parallel with said tank-venting system.

6. The method of claim 3, wherein said vessel is a tank-venting system, the tank-venting system including a tank, an adsorption filter, a tank-connecting line connecting the tank to the adsorption filter, a tank-venting valve; and, a valve line connecting the tank-venting valve to the adsorption filter; and, wherein the method comprises the further step of simulating said reference leak by controlling said tank-venting valve to partially open the same.

7. An arrangement for checking the operability of a vessel, the arrangement comprising:

a pressure source for charging said vessel with a pressure;

said pressure source having operating variables which vary during operational use thereof;

a circuit unit for detecting and evaluating said operating variables as said pressure is introduced into said vessel;

a reference leak mounted parallel to said vessel; and, a switching device for alternately connecting said pressure source to said vessel and said reference leak.

8. The arrangement of claim 7, wherein said switching device is a 3/2-way valve.

9. The arrangement of claim 7, wherein said switching device is a 4/2-way valve.

10. The arrangement of claim 7, wherein said reference leak is formed as part of said switching device.

11. The arrangement of claim 7, wherein said pressure source is a pump.

12. An arrangement for checking the operability of a vessel, the arrangement comprising:

a pressure source for charging said vessel with a pressure;

said pressure source having operating variables which vary during operational use thereof;

a circuit unit for detecting and evaluating said operating variables as said pressure is introduced into said vessel;

said operating variables characterize the output volume flow of said pressure source; and, said operating variables including: current input to said pressure source, rpm of said pressure source and voltage applied to said pressure source.

* * * * *